United States Patent [19]

Tucker

[11] Patent Number: 4,724,988

[45] Date of Patent: Feb. 16, 1988

[54] INFANT CARRIER

[76] Inventor: Debby Tucker, 2315 N.E. 91st St., Seattle, Wash. 98115

[21] Appl. No.: 880,736

[22] Filed: Jul. 1, 1986

[51] Int. Cl.[4] ..... A47D 13/02

[52] U.S. Cl. ..... 224/160

[58] Field of Search ..... 224/158-161; D3/31

[56] References Cited

U.S. PATENT DOCUMENTS

| | | | |
|---|---|---|---|
| D. 277,811 | 3/1985 | Moore . | |
| 3,027,058 | 3/1962 | Huber | 224/160 X |
| 3,197,100 | 7/1965 | Thompson . | |
| 3,871,562 | 3/1975 | Grenier | 224/160 |
| 4,139,131 | 2/1979 | Hathaway | 224/160 |
| 4,149,687 | 4/1979 | Nunemacher . | |
| 4,234,229 | 11/1980 | Arnold | 224/160 X |
| 4,271,998 | 6/1981 | Ruggiano . | |
| 4,402,440 | 9/1983 | Purtzer et al. . | |
| 4,436,233 | 3/1984 | Hill et al. | 224/159 |
| 4,467,945 | 8/1984 | Schaapveld | 224/160 |
| 4,469,259 | 9/1984 | Krich et al. . | |
| 4,492,326 | 1/1985 | Storm . | |
| 4,579,264 | 4/1986 | Napolitano | 224/160 |
| 4,606,078 | 8/1986 | Tkacsik | 224/160 X |

FOREIGN PATENT DOCUMENTS 929949 1/1948 France .

*Primary Examiner*—Stephen Marcus
*Assistant Examiner*—Robert M. Petrik
*Attorney, Agent, or Firm*—Christensen, O'Connor, Johnson & Kindness

[57] ABSTRACT

Disclosed is a flexible, lightweight infant carrier that is suspendable from a wearer's shoulders and configured to define a seat that permits the infant to assume a seated position with its knees raised relative to its buttocks and the backs of its thighs comfortably supported. With an infant seat formed in accordance with this invention, nearly all of the infant's weight is carried by the seat where it supports the infant's buttocks. Very little of the infant's weight is borne by the edge of the seat where it contacts the infant's legs. Accordingly, the infant's thighs do not press uncomfortably against the edge of the seat. The present invention also provides a flexible infant carrier that is readily adaptable for wearing with an infant facing toward or away from the wearer.

8 Claims, 4 Drawing Figures

INFANT CARRIER

BACKGROUND OF THE INVENTION

This invention relates to flexible infant carriers that are worn by the person who carries the infant.

Various configurations of flexible infant carriers that are worn by the person carrying the infant are known in the art. Most such prior art designs feature a seat or pouch suspended by straps from the wearer's shoulders. Some of these carriers are configured to support the child in front of the wearer with the infant facing either inwardly toward the wearer (usually preferred for very young infants) or outwardly, free to observe the surroundings.

The seat portion of prior art devices is usually formed of fabric having holes through which the infant's legs extend. (See, for example, U.S. Pat. No. 4,149,687 issued to Nunemacher; U.S. Pat. No. 4,402,440 issued to Purtzer et al.; and U.S. Pat. No. 4,469,259 issued to Krich et al.). This structure essentially suspends the infant by the crotch of the legs with much of the infant's weight carried by the edges of the leg holes. As a result, the leg hole edges press against the infant's thighs. The pressure of the edges of the leg holes against the infant's thighs creates discomfort and consequent restlessness in the infant.

Some infant carrier designs, such as illustrated in Ruggiano, U.S. Pat. No. 4,271,998, utilize substantially rigid seating platforms suspended to project horizontally outwardly from the wearer. These designs are relatively bulky, making the device uncomfortable to wear and reducing the wearer's freedom of movement. Furthermore, these platform-type designs are not readily adaptable for carrying the infant facing inwardly toward the wearer.

SUMMARY OF THE INVENTION

This invention is directed to a flexible, lightweight infant carrier that is suspendable from a wearer's shoulders and configured to define a seat that permits the infant to assume a seated position with its knees raised relative to its buttocks and the backs of the thighs comfortably supported. With an infant carrier formed in accordance with this invention, nearly all of the infant's weight is carried by the seat of the carrier where it supports the infant's buttocks. Very little of the infant's weight is borne by the edge of the seat where it contacts the infant's legs. Accordingly, the infant's thighs do not press uncomfortably against the edge of the seat. The present invention also provides a flexible infant carrier that is readily adaptable for wearing with the infant facing either toward or away from the wearer.

The seat portion of an infant carrier formed in accordance with this invention comprises a number of attached panels including:

(a) a substantially rectangular back panel having a top edge, a bottom edge, and opposing left and right side edges;

(b) a substantially rectangular left side panel having opposing inner side and outer side edges and opposing front and back edges. The inner side edge of the left panel is integrally formed with the left side edge of the back panel;

(c) a substantially rectangular right side panel having opposing inner side and outer side edges and opposing front and back edges. The inner side edge of the right side panel is integrally formed with the right side edge of the back panel; and (d) a front panel having a lower edge, an upper edge and opposing left and right side edges. The lower edge of the front panel is integrally attached to the bottom edge of the back panel. The left side edge of the front panel is joined to the front edge of the left side panel, and the right side edge of the front panel is joined to the front edge of the right side panel.

The infant carrier also comprises a flexible bib panel with one edge attached along the central portion of the upper edge of the front panel. Shoulder harnesses are interconnected between the back edges of the left and right side panels and the bib panel. The panels and shoulder harnesses are configured so that when the infant carrier is worn, the infant is received within the carrier with its buttocks resting against the region where the front and back panels are attached and with the backs of its thighs supported by the front panel. The front panel is suspended in a plane that slopes downwardly toward the wearer, thus the infant's knees are supported relatively higher than its buttocks. The left and right side panels are held in somewhat vertical planes against the infant's hips, thereby minimizing side-to-side shifting of the infant and the resulting imbalance in the wearer.

BRIEF DESCRIPTION OF THE DRAWINGS

The invention, with its attendant advantages, will become better understood from the following detailed description when considered in combination with the accompanying drawings, wherein.

DETAILED DESCRIPTION OF THE PREFERRED EMBODIMENT

Figure 1:
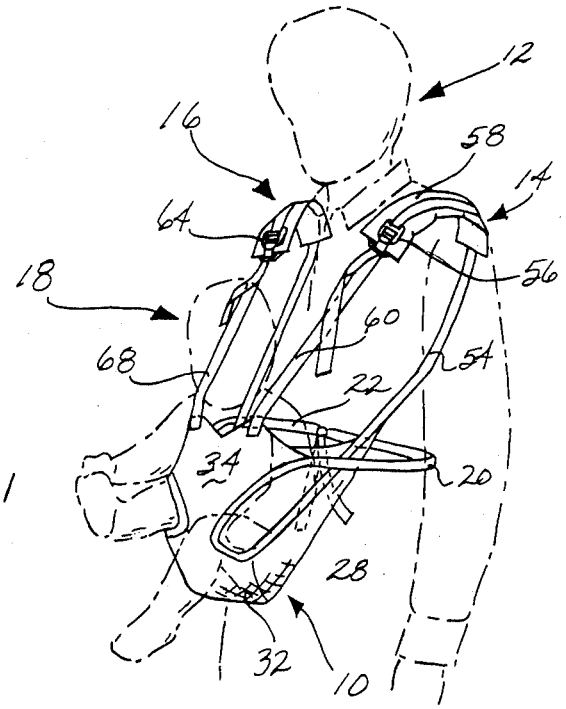
FIG. 1 is a perspective view of an infant carrier formed in accordance with this invention showing the carrier worn with the infant facing away from the wearer.

With reference to FIG. 1, the infant carrier formed in accordance with this invention generally comprises a seat 10 suspended from the shoulders of a wearer 12 by shoulder harnesses 14, 16. The seat is configured to receive an infant 18 in a seated position with its knees relatively higher than its buttocks. Waist straps 20, 22 are attached to the seat and wrap around the wearer's waist for tying in back. The waist straps keep the infant and seat 10 from swinging away from the wearer's body.

Figure 2:
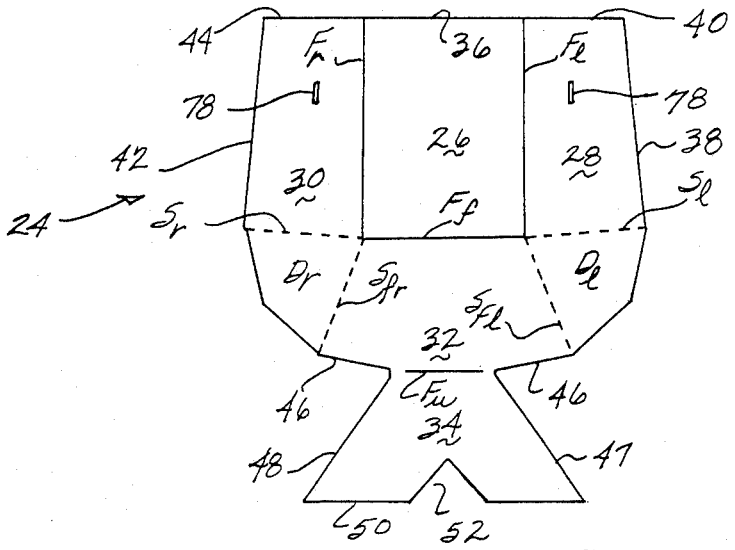
FIG. 2 is a plan view showing only the unassembled seat portion of the infant carrier.

Preferably, the infant carier is formed of durable, flexible material such as cotton fabric. FIG. 2 illustrates the preferred configuration of a single piece of fabric 24 that is adaptable to form the seat 10 of the carrier. The piece of fabric 24 is most clearly described as comprising a number of integrally attached panels: a back panel 26; a left side panel 28; a right side panel 30; a front panel 32; and a bib panel 34. The "left" and "right" orientation corresponds to that of the wearer shown in FIG. 1.

The back panel 26 is generally rectangular having a back edge 36 and an opposing substantially parallel bottom edge defined by a front fold line $F_f$ in the fabric. The front fold line $F_f$ and other fold lines described below are shown in the drawings for illustrative purposes and represent a line about which the fabric is folded when the carrier is assembled and worn with an infant seated therein. The left side edge of the back panel is defined by a left fold line $F_l$. The opposing right side edge of the back panel 26 is defined by a right fold line $F_r$.

The left side panel 28 is substantially rectangular shaped, having an outer edge 38 and an opposing inner edge that is integrally attached to the left side edge of the back panel 26 at the left fold line $F_l$. The left side panel 28 also includes a back edge 40, which is an extension of the top edge 36 of the attached back panel, and an opposing substantially parallel front edge defined by a stitch line $S_l$ in the fabric. The stitch line $S_l$ is represented as a dotted line in FIG. 2. The stitch line $S_l$ and other stitch lines described below are shown in the drawings for illustrative purposes and represent lines in the fabric that are joined to corresponding stitch lines, preferably by sewing, to construct the seat of the infant carrier as described more fully below.

The right side panel 30 is substantially rectangular shaped, having an outer edge 42 and an opposing inner edge that is integrally attached to the right side edge of the back panel 26 at the right fold line $F_r$. The right side panel 30 also includes a back edge 44, which is an extension of the top edge 36 of the attached back panel, and an opposing substantially parallel front edge defined by a stitch line $S_r$ in the fabric.

The front panel 32 has a lower edge that is integrally formed with the bottom edge of the back panel 26 at the front fold line $F_f$. The front panel also includes a left side edge defined by a stitch line $S_{fl}$ and an opposing right side edge defined by a stitch line $S_{fr}$. The left and right side edges of the front panel extend in slightly diverging relation outwardly from the lower edge of the front panel.

The front panel 32 has an upper edge 46 to which the bib panel 34 is integrally attached at the central portion thereof along a fold line $F_u$. The bib panel 34 extends outwardly from the front panel and has opposing left and right side edges 47, 48 that extend outwardly from the front panel in diverging relation; hence, the bib panel becomes wider away from the front panel. The outermost edge 50 of the bib panel has a V-shaped notch 52 formed therein.

In the embodiment shown in the figures, the fabric piece 24 from which seat 10 is formed includes a generally triangular-shaped piece $D_l$ located between the stitch lines $S_l$, $S_{fl}$ that define the front edge of the left side panel 28 and the left side edge of the front panel 32. Likewise, a generally triangular-shaped piece $D_r$ is located between the stitch lines $S_r$, $S_{fr}$ that define the front edge of the right side panel 30 and the right side edge of the front panel 32.

The infant carrier is assembled by joining the front edge of the left side panel 28 to the left side edge of the front panel 32. Specifically, the stitch lines $S_l$, $S_{fl}$ that define those edges are sewn together. The triangular-shaped piece $D_l$ that is located between those stitch lines is folded inwardly and against the front panel, the resulting configuration forming a dart in the fabric at the junction of the front panel and the left side panel. The front edge of the right side panel 30 and the right side edge of the front panel 32 are joined by sewing together the stitch lines $S_r$, $S_{fr}$ that define those edges and folding the triangular-shaped piece $D_r$ against the front panel to create a second dart in the fabric at the junction of the front and right side panels. When the front panel 32 and the left and right side panels 28, 30 of the fabric piece 24 are joined as just described, the front panel is folded about its lower edge (i.e., fold line $F_f$) and the left and right side panels are folded about their respective inner edges (i.e., fold lines $F_l$ and $F_r$, respectively).

As noted earlier, the seat 10 is supported on the wearer by left and right shoulder harnesses 14, 16. The left shoulder harness 14 includes a back strap 54 that has one end affixed to the back edge 40 of the left side panel 28 near the outer side edge 38 of that panel. The opposing end of the back strap 54 is fastened to a conventional ladder-type adjustment buckle 56. An elongate pad 58 is fastened to the back strap 54 along the end nearest the buckle 56. The buckle 56 is mounted to one end of the pad 58. The left shoulder harness 14 also includes a front strap 60 that has one end fastened to the outermost edge of the bib panel 34 near the V-shaped notch 52. The other end of the front strap 60 passes through a guide loop 55 that is attached to the end of the pad 58 near the buckle 56, and then through the slots in the buckle 56.The front strap is slidable in the buckle for adjusting the length of the front strap between the buckle and the bib panel 34.

The right shoulder harness 16 is configured substantially identically to the left shoulder harness 14 and includes a back strap 62, buckle 64, a pad 66, a guide loop 65, and front strap 68 arranged in like manner to the corresponding parts of the left shoulder harness 14.

One of the waist straps 20, 22 is attached to the uppermost edge 50 of the bib panel 34 near each side edge 47, 48 of the bib panel. The other ends of the waist straps are free for typing as mentioned earlier.

Figure 3:
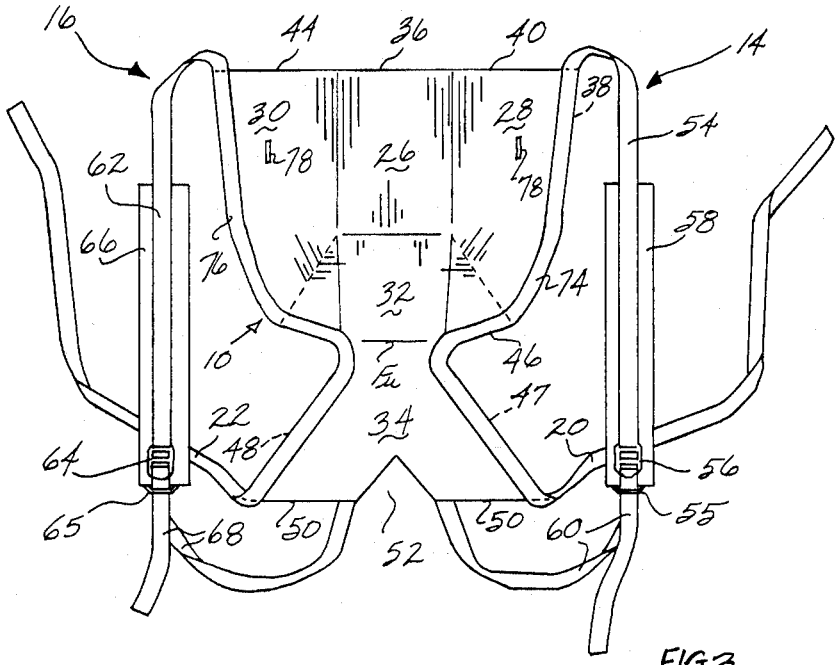
FIG. 3 is a plan view of a fully assembled infant carrier.

Preferably, each back strap 54, 62 is contiguously connected to its associated (i.e., same side) waist strap 20, 22 via an intermediate strap portion 74, 76. Specifically, as shown in FIG. 3, the back strap 54 of the left shoulder harness 14 and associated waist strap 20 are each part of a single strap that includes an intermediate portion 74 that is integrally attached to the back strap at the attachment point of the back strap and left side panel. The intermediate portion extends along the outer side edge 38 of the left side panel 28, across a portion of the upper edge 46 of the front panel 32, along the left side edge 47 of the bib panel 34, to where it meets the waist strap 20 at the point the waist strap attaches to the bib panel.

The back strap 62 and waist strap 22 of the right side of the carrier are also parts of a single strap having an intermediate portion 76 configured and arranged in substantially identical manner to the left side intermediate strap portion 74. The use of a contiguous strap provides a more durable shoulder harness that is relatively easy to manufacture. It is contemplated, however, that acceptable results will be achieved if separate back and waist straps are used.

One method of wearing the infant carrier formed in accordance with this invention is illustrated in FIG. 1. The shoulder harness 14, 16 pass over the wearer's shoulders so that the seat is suspended at approximately waist level with the infant 18 seated within the seat 10. The infant can be placed in the seat either before or after the shoulder harnesses are placed over the wearer's shoulders. When seated in the carrier, the infant's buttocks rest in the region where the back and front panels are attached. The waist straps 20, 22 are drawn around the wearer's waist and tied.

As noted earlier, the front panel 32 is folded upwardly along the front fold line $F_f$ toward the back panel. The front straps 60, 68 of the left and right shoulder harnesses 14, 16 are adjusted to hold the bib panel 34 against the chest of the infant. The notch 52 in the bib panel permits the infant to drop its head (e.g., during a nap) without having the edge of the bib panel pressing against its neck. The bib panel 34 communicates the tension in the front straps 60, 68 to the upper edge of the front panel that is defined by the fold line $F_u$. As a result the front panel 32 is substantially held in a plane that slopes upwardly from the front fold line $F_f$ to support the backs of the infant's thighs in a comfortable position with its knees slightly raised relative to its buttocks.

As noted, the junction of the front panel 32 with the left and right side panel edges results in those side panels 28, 30 being folded upwardly about the left and right fold lines $F_l$, $F_r$. When carrying an infant as shown in FIG. 1, the left and right side panels are supported by the shoulder harnesses in substantially vertical planes. Thus, the portion of the left side panel 28 that is near the front panel 32 is held against the left hip and upper thigh of the seated infant. Likewise, the portion of the right side panel 30 that is near the front panel 32 is held against the right hip and upper thigh of the seated infant. This configuration secures the infant in the seat while minimizing the infant's side-to-side shifting, which can create imbalance in the wearer.

Since the left and right side panels 28, 30 are disposed against the infant's hips and upper thighs as just described, the infant's legs are held in a comfortable, knees-forward position. In this regard, it is noteworthy that the bib panel 34 is configured to provide chest support for the infant without interferring with the knees-forward position of the infant's legs. More specifically, the bib panel 34 is relatively narrow where it attaches to the central portion of the upper edge 46 of the front panel 32 (i.e., fold line $F_u$ in FIGS. 2 and 3). Thus, there is space on either side of this lower portion of the bib panel for the infant to extend its legs forwardly over the front panel.

Figure 4:
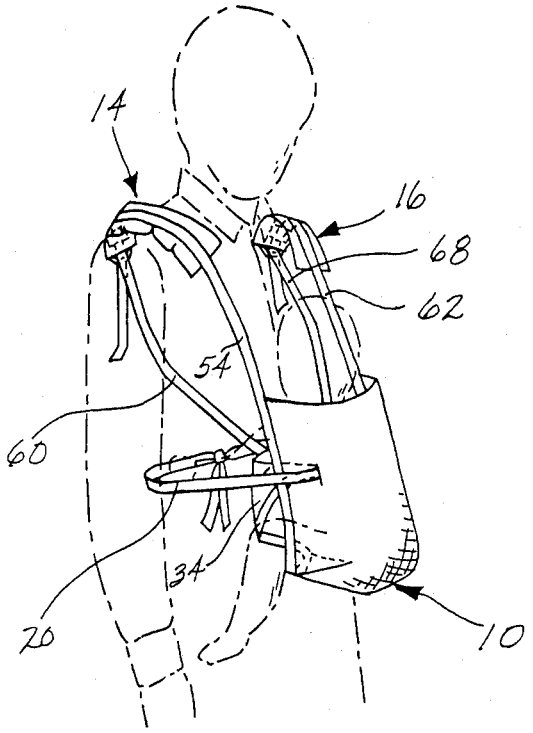
FIG. 4 is a perspective view of another arrangement for the infant carrier of FIG. 1, wherein the infant is carried facing the wearer.

FIG. 4 illustrates another arrangement for the infant carrier for carrying the infant while it faces the wearer. This arrangement is achieved essentially by placing the left shoulder harness 14 over the right shoulder of the carrier and the right shoulder harness 16 over the left shoulder of the carrier. To keep the bib panel 34 supported against the infant's chest when in this position, a slit 78 is provided in each of the left and right side panels 28, 30 near their top edges 40, 44 (see FIG. 2). Waist straps 20, 22 are passed through the slits before being tied behind the wearer's back. The tension in the tied waist straps tends to draw the bib panel 34 toward the infant while still holding the carrier near the wearer.

While the present invention has been described in relation to a preferred embodiment it is to be understood that various changes, substitutions or equivalents and other alterations can be made without departing from the spirit and scope of this invention.

I claim:

1. An infant carrier for carrying an infant in front of a wearer comprising:

(a) a substantially rectangular flexible back panel having a top edge, a bottom edge, a left side edge and a right side edge, when said flexible back panel rests against the front of the wearer, said left side edge and said right side edge correspond to the wearer's left side and right side respectively;

(b) a substantially rectangular left side panel having opposing inner side and outer side edges and opposing front and back edges, the inner side edge of the left side panel being integrally formed with the left side edge of the back panel;

(c) a substantially rectangular right side panel having opposing inner side and outer side edges and opposing front and back edges, the inner side edge of the right side panel being integrally formed with the right side edge of the back panel;

(d) a front panel having a lower edge and opposing upper edge, the front panel also having opposing left and right side edges, the lower edge of the front panel being attached to the bottom edge of the back panel, the left side edge of the front panel being joined to the front edge of the left side panel, the right side edge of the front panel being joined to the front edge of the right side panel;

(e) a flexible bib panel attached along a central portion of the upper edge of the front panel, the bib panel also having an uppermost edge;

(f) a left shoulder harness interconnected between the back edge of the left side panel and the uppermost edge of the bib panel; and a right shoulder harness interconnected between the back edge of the right side panel and the uppermost edge of the bib panel;

(g) when worn, the infant carrier being configured to receive an infant facing away from the wearer with its buttocks resting in the region where the back and front panels are attached and with the back of the infant's thighs supported by the front panel so that the infant's knees are supported relatively higher than its buttocks and substantially all of the infant's weight is supported under its buttocks, the front panel being suspended to slope upwardly from the bottom edge of the back panel, the portion of the left side panel that is near the left side edge of the front panel being disposed in a substantially vertical plane against the left hip of the infant, the portion of the right side panel that is near the right side edge of the front panel being disposed in a substantially vertical plane against the right hip of the infant; and (h) the infant carrier being adaptable such that when the left shoulder harness is on the wearer's right shoulder and the right shoulder harness is on the wearer's left shoulder an infant is carried in front of the wearer, facing towards the wearer.

2. The carrier of claim 1 further including a pair of waist straps, each waist strap being attached at one end to the bib panel near the uppermost edge thereof.

3. The carrier of claim 2 further including a notch formed in the uppermost edge of the bib panel.

4. The carrier of claim 1 further including a slit formed in both the left and right side panels for receiving an associated waist strap.

5. The carrier of claim 1, wherein the left and right shoulder harnesses each include adjustment means operable for adjusting the length of the harnesses to hold the front panel in an upwardly sloping plane.

6. An infant carrier for carrying an infant in front of a wearer comprising:

(a) a flexible back panel having a bottom edge, a top edge, and opposing side edges for resting against the front of a wearer;

(b) a front panel having a lower edge and opposing upper edge, the front panel also having opposing side edges, the front panel being attached at its lower edge to the bottom edge of the back panel; and (c) support means for suspending the front and back panels from the shoulders of a wearer such that the buttocks of an infant positioned between the panels and facing away from the wearer rest in the region where the front and back panel are attached, and so that the front panel supports the backs of the infant's thighs with its knees raised relative to its buttocks so that substantially all of the infant's weight is supported under its buttocks, the support means being adaptable for reversing the position of the front and back panels so that the infant can be carried in front of the wearer, facing towards the wearer.

7. The carrier of claim 6, wherein the support means includes:

(a) side panels interconnected between the side edges of the back panel and the side edges of the front panel, the side panels supported in substantially vertical planes against the infant's hips for holding the infant's legs in a substantially forwardly-oriented position; and (b) a bib panel connected to the upper edge of the front panel and extending across the infant's chest.

8. The carrier of claim 4, wherein the support means also includes a pair of shoulder harnesses, each shoulder harness being interconnected between the bib panel and a side panel, the shoulder harness including adjustment means for adjusting the length of the shoulder harness.

* * * * *